US005862911A

United States Patent [19]

Phillips, II et al.

[11] Patent Number: 5,862,911

[45] **Date of Patent: *Jan. 26, 1999**

[54] PRODUCT FOR PROTECTIVELY PACKAGING APPLIANCES FOR STORAGE AND SHIPMENT

[75] Inventors: Stephen Allan Phillips, II; Jeffery Edward Myers, both of Gastonia, N.C.; Robert Bradley Elmore, Florence, S.C.

[73] Assignee: Modern Polymers, Inc., Cherryville, N.C.

[ * ] Notice: The term of this patent shall not extend beyond the expiration date of Pat. No. 5,701,999.

[21] Appl. No.: 998,361

[22] Filed: Dec. 24, 1997

Related U.S. Application Data

[63] Continuation of Ser. No. 634,047, Apr. 17, 1996, Pat. No. 5,701,999.

[51] Int. Cl.[6] ..... B65D 85/30; B65D 71/08

[52] U.S. Cl. ..... 206/320; 206/497; 206/523; 206/588

[58] Field of Search ..... 206/320, 497, 206/521, 523, 586, 588, 590

[56] References Cited

U.S. PATENT DOCUMENTS

| | | | |
|---|---|---|---|
| 2,932,438 | 4/1960 | Smith | 206/590 X |
| 3,363,749 | 1/1968 | Tinapple | 206/320 |
| 3,835,986 | 9/1974 | Le Beav | 206/320 |
| 4,823,956 | 4/1989 | Belisle | 206/523 |
| 4,851,286 | 7/1989 | Maurice | 206/523 X |
| 4,881,641 | 11/1989 | Mattingly et al. | 206/320 |
| 5,307,928 | 5/1994 | Bishop | 206/320 |
| 5,701,999 | 12/1997 | Phillips, II et al. | 206/320 |

*Primary Examiner*—Bryon P. Gehman
*Attorney, Agent, or Firm*—Adams Law Firm, P.A.

[57] ABSTRACT

A protective shipping and storage package for appliances, including a polymeric foam protective base cap for being fitted onto a base of the appliance and a polymeric foam protective top cap for being fitted onto a top of the appliance opposed to the base. A plurality of protective side panels are provided for being positioned on opposite side walls of the appliance and interconnecting the base and top caps. The side panels have opposite ends for respectively engaging and cooperating with the base cap and top cap to form a protective package around the appliance. A retaining shroud is positioned on and extends around the appliance and the assembled top cap, base cap and plurality of side panels for securing the protective package in its protective position around the appliance. The shroud may be a shrink-wrap type of plastic film.

16 Claims, 4 Drawing Sheets

PRODUCT FOR PROTECTIVELY PACKAGING APPLIANCES FOR STORAGE AND SHIPMENT

This application is a 37 C.F.R. §1.53(b) continuation application of U.S. Ser. No. 08/634,047 filed Apr. 17, 1996, and issued as U.S. Pat. No. 5,701,999.

TECHNICAL FIELD AND BACKGROUND OF THE INVENTION

This invention relates to a package designed to protect appliances, such as washing machines, clothes dryers, water heaters and similar products during shipment and storage. For purposes of illustration, a package intended for a conventional upright storage tank-type electric hot water heater is disclosed. A package of the type disclosed in this application is adaptable for use with virtually any type of appliance, particularly those which are relatively large and heavy, yet constructed of relatively thin sheet metal and thus susceptible to damage during shipment.

Appliances of this type are conventionally packaged in corrugated cardboard boxes which have top and bottom caps, a surrounding box with corrugated cardboard sleeves inserted into the box to wedge the appliance into a stationary position in the box.

Assembly takes place by placing the appliance on a base, placing sheets of cardboard around the appliance, putting a top on the appliance, and wedging sleeves of corrugated cardboard into the box. The boxes are typically held together by strapping, which must later be cut in order to disassemble the box and remove the appliance.

These cardboard boxes are sufficiently rigid that three at a time can be picked up by a lift truck, which squeezes the boxes together side-by-side and lifts them at the same time. These boxes are relatively expensive to produce. Aside from the fabrication of the corrugated cardboard itself, the box must be cut, folded, glued and otherwise formed into a fabricated shape customized for the unique size and shape of each particular appliance.

While the cardboard is recyclable, the recycling process is relatively expensive and often not economically feasible.

The present invention presents several advantages over prior art packaging and packaging processes. By using injection-molded polymeric foam, components can be easily made in large quantities with molded shapes which fit exactly to the shape of the appliance. The foam components are easily reusable or recyclable. The foam components of the packaging use a minimum of mass, and enclose only those parts of the appliance most susceptible to damage. Using shrink-wrap film to hold the other components together creates a tight, protective unit which is nevertheless quick and easy to disassemble.

In addition, the structure of the packaging permits appliance manufacturers to continue handling the appliances in a conventional manner during assembly, packaging, shipment and storage. The end result is a package which offers superior protection at a very low cost.

SUMMARY OF THE INVENTION

Therefore, it is an object of the invention to provide an appliance packaging product which is inexpensive.

It is another object of the invention to provide an appliance packaging product which can be easily made into a wide variety of shapes in order to fit a desired appliance exactly.

It is another object of the invention to provide an appliance packaging product which can be easily and inexpensively recycled or reused.

It is another object of the invention to provide an appliance packaging product which permits the appliance manufacturer to handle the appliance during assembly, packaging, shipment and storage in a conventional manner.

These and other objects of the present invention are achieved in the preferred embodiments disclosed below by providing a protective shipping and storage package for appliances, comprising a polymeric foam protective base cap for being fitted onto a base of the appliance and a polymeric foam protective top cap for being fitted onto a top of the appliance opposed to the base. A plurality of protective side panels are provided for being positioned on opposite side walls of the appliance and interconnecting the base and top caps. The side panels have opposite ends for respectively engaging and cooperating with the base cap and top cap to form a protective package around the appliance. Retaining means are positioned on and extend around the appliance and the assembled top cap, base cap and plurality of side panels for securing the protective package in its protective position around the appliance.

According to one preferred embodiment of the invention, the top cap and the base cap each include inner walls molded to snugly fit a predetermined appliance shape.

According to another preferred embodiment of the invention, the top cap and base cap each include connection means for connecting to the a respective one of the side panels.

According to yet another preferred embodiment of the invention, the side panels each include connection means for mating connection with the connection means of the top cap and the base cap.

According to yet another preferred embodiment of the invention, the top cap and base cap connection means comprise one of a male or a female connecting member and the side panel connection means comprises the other of the male or female connecting member.

Preferably, the female connecting member comprises a notch and the male connecting member comprises a tab for being positioned in the notch.

According to yet another preferred embodiment of the invention, the notch extends through the entire thickness of the top cap and the bottom cap and the tab extends through the entire thickness of the side panels. The side panels are preferably fabricated of polymeric foam material such as expanded polystyrene.

According to yet another preferred embodiment of the invention, the male and female connecting members cooperate together for a press fit.

Preferably, the retaining means comprises a sheet material, such as a heat-shrinkable plastic film.

According to yet another preferred embodiment of the invention, the heat-shrinkable plastic film is formed into a tube having dimensions in an initial unshrunk condition to be placed over and around the assembled appliance, top cap, base cap and side panels, and a degree of shrinkage sufficient to tightly secure the protective top cap, base cap and side panels to the appliance when shrunk.

According to yet another preferred embodiment of the invention, the appliance comprises a cylindrical water heater, and the protective package includes four side panels spaced at regular intervals around the periphery of the water heater.

The method according to a preferred embodiment of the invention comprises a method of protectively packaging an appliance having a base, top and side walls for shipping and storage. The method comprises the steps of fitting a molded protective polymeric foam base cap to the base of the appliance, and fitting protective side panels onto at least two opposing side walls, the side walls extending along the side panels of the appliance towards the top of the appliance. The side panels are supported on the base cap, and a molded protective polymeric foam top cap is fitted onto the top of the appliance. The top cap engages a top end of each of the side panels and retains the assembled top cap, base cap and side panels on the appliance.

According to one preferred embodiment of the invention, the step of supporting the side panels on the base cap includes the step of fitting one of a male or female connecting member carried on a lower end of the side panel into the other of the male or female connecting member carried on the base cap.

According to another preferred embodiment of the invention, the step of engaging the top cap and the side panels includes the step of fitting one of a male or female connecting member carried on an upper member of the side panel into the other of the male or female connecting member carried on the base cap.

According to yet another preferred embodiment of the invention, the step of retaining the assembled top cap, base cap and side panels on the appliance comprises the step of wrapping the assembled top cap, base cap, side panels and appliance with a plastic film.

Preferably, the step of wrapping with plastic film comprises a placing a tube of heat-shrinkable plastic in an initial unshrunk condition over and around the assembled appliance, top cap, base cap and side panels, and applying heat sufficient to shrink the film into a tight condition sufficient to secure the protective top cap, base cap and side panels to the appliance.

According to yet another preferred embodiment of the invention, the steps of supporting the side panels on the base cap and engaging the top cap and a top end of each of the side panels comprises the steps of connecting tabs by means of a press fit onto the opposing ends of the side panels into mating notches formed in the respective top cap and base cap.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENTS AND BEST MODE

Figure 1:
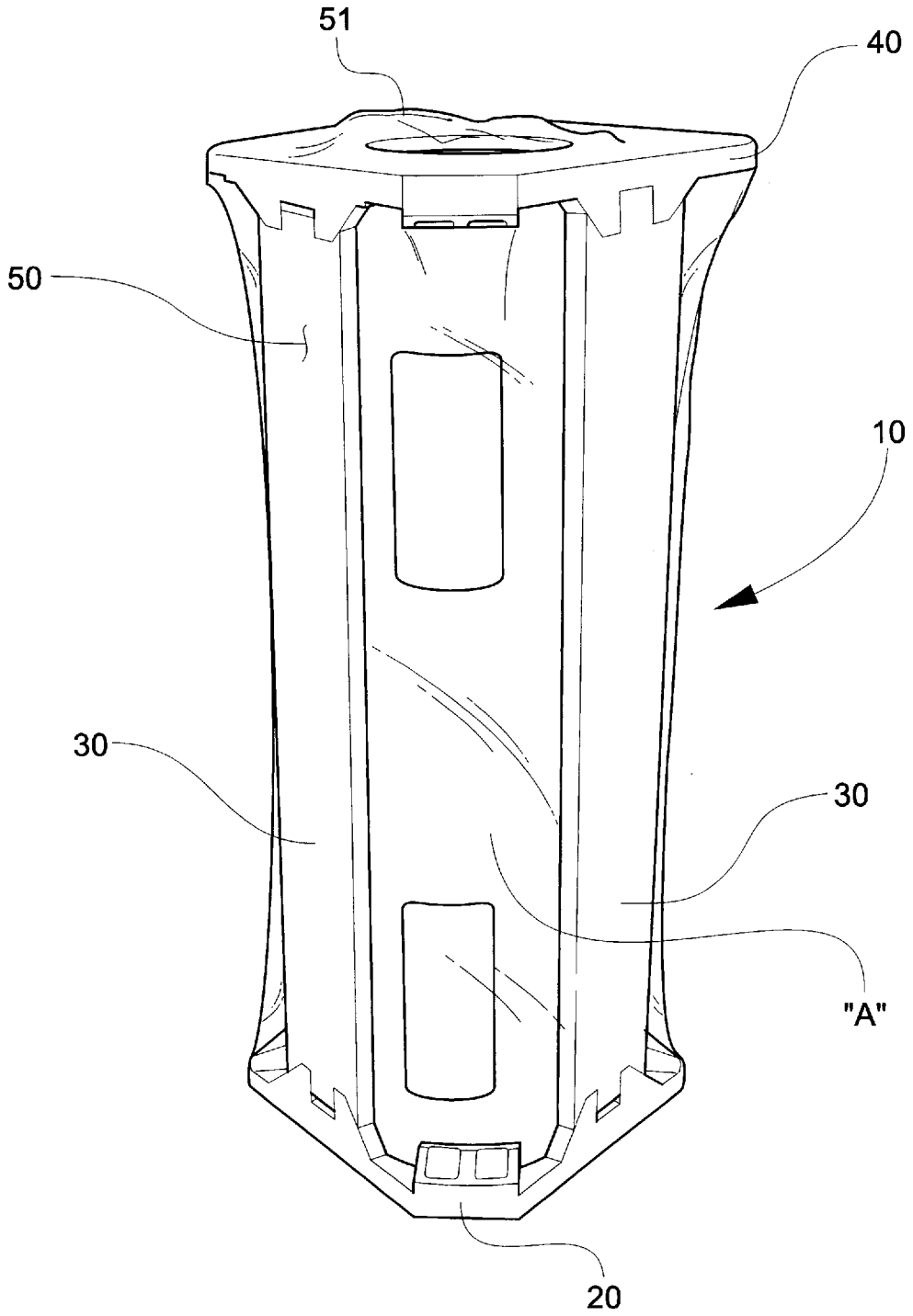
FIG. 1 is a perspective view of an assembled package according to a preferred embodiment of the invention in place on a water heater.
Figure 2:
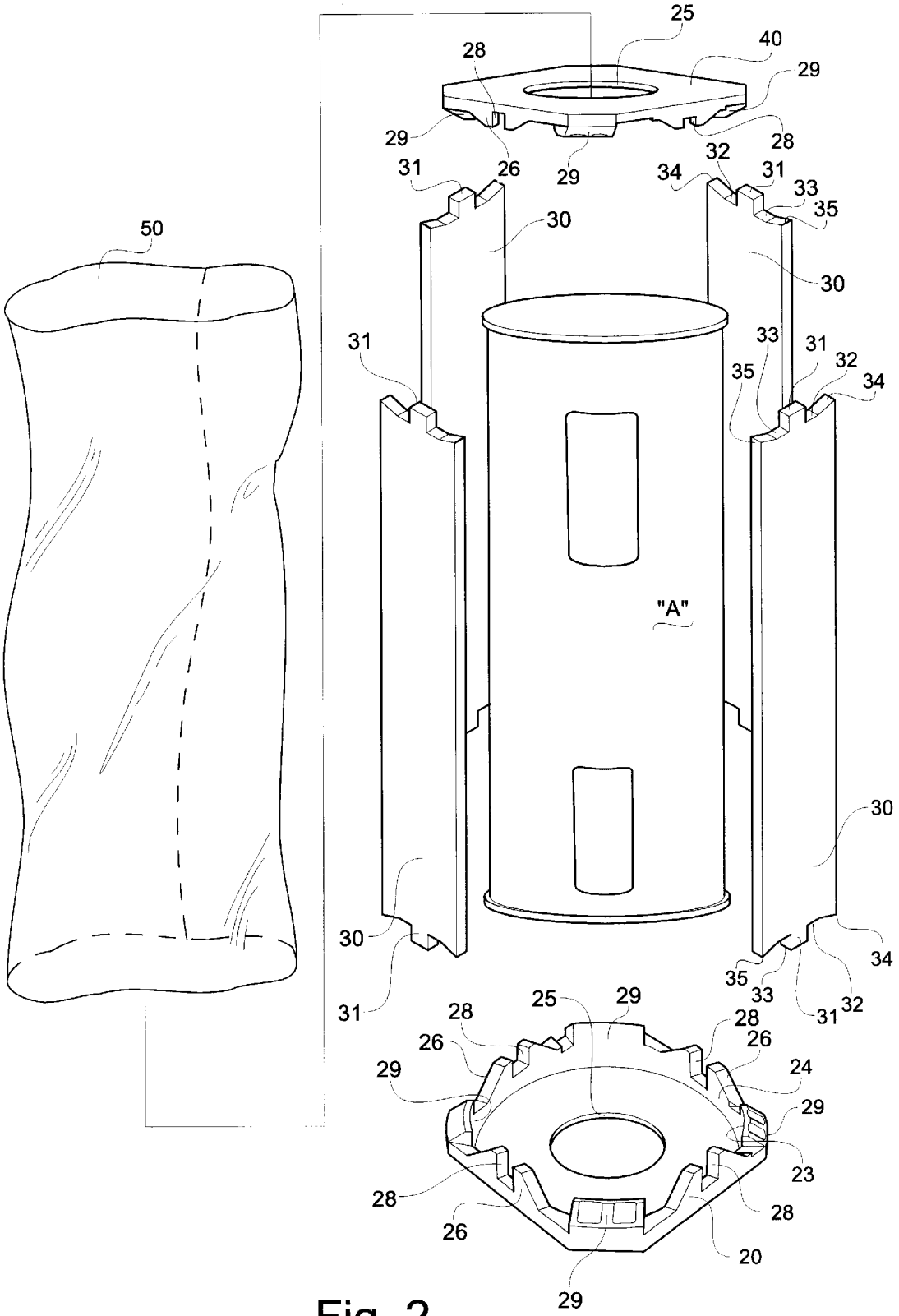
FIG. 2 is an exploded view of the assembled package shown in FIG. 1.

Referring now specifically to the drawings, an appliance package according to the present invention is illustrated in FIGS. 1 and 2 and shown generally at reference numeral 10. Package 10 is shown in place on a cylindrical, tank-type electric hot water heater appliance "A". As noted above, the package according to the invention can be used with many different types of appliances, the water heater "A" being one example.

In general, the package 10 includes a base cap 20 onto which the water heater "A" is fitted during assembly. Four side panels 30, two of which are shown in FIG. 1, and all in FIG. 2, are supported on the base cap 20 and extend upwardly along the cylindrical side walls of the water heater "A". A top cap 40 is fitted onto the top of the water heater "A" and mates with the upper end of the side panels 30 to form an integrated package.

The base cap 20, side panels 30 and top cap 40 are held tightly in place by a tubular retainer shroud 50 formed of shrink-wrap plastic film. The shroud 50 is formed oversized relative to the size of the appliance, so that it can be pulled over the appliance and the package components and correctly positioned. When heated, the film shrinks, tightly binding the package components into a integrated unit, as described in further detail below.

Figure 3:
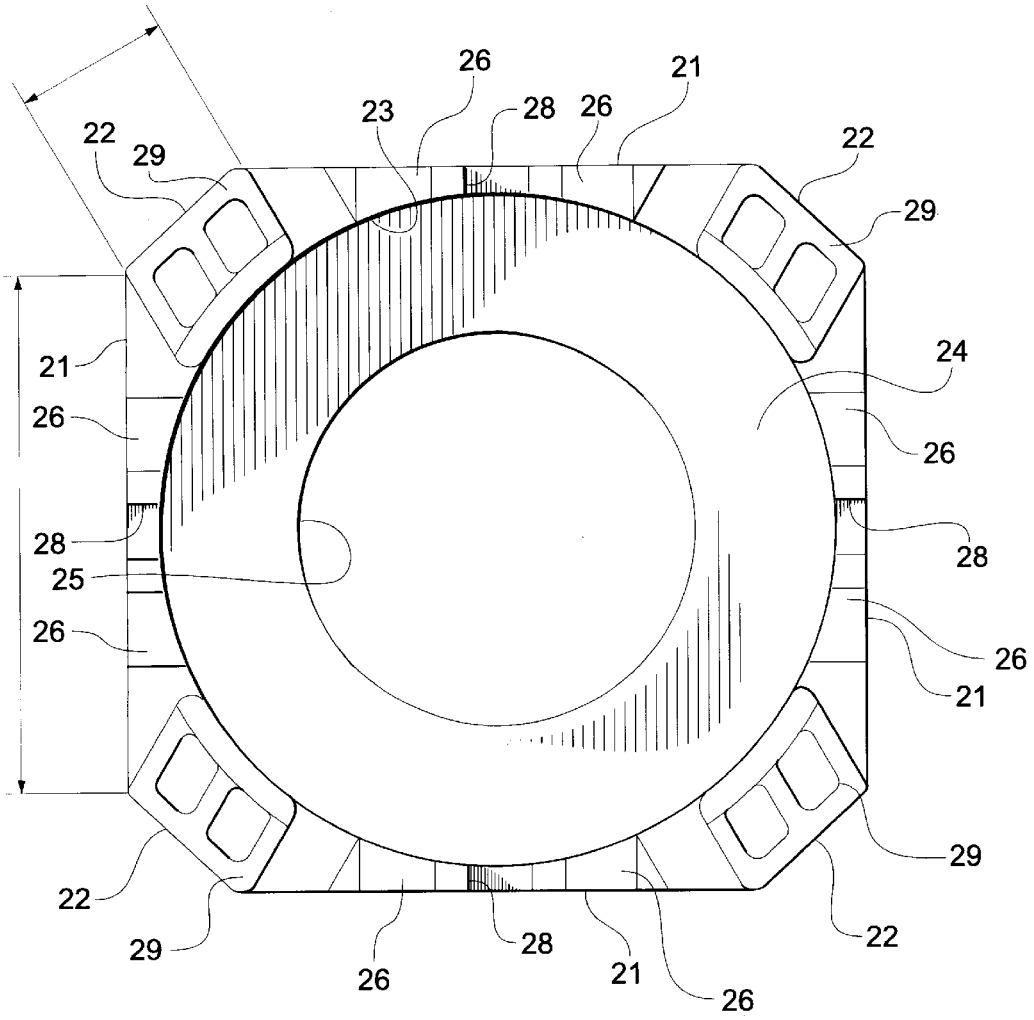
FIG. 3 is a plan view of a top cap or base cap shown in FIGS. 1 and 2.

Referring now more specifically to the structure of the individual components, FIG. 3 shows a base cap 20 according to the preferred embodiment disclosed in this application. In this particular embodiment, the base cap 20 and the top cap 40 are identical in structure, the top cap 40 being inverted from the orientation of he base cap 20. This is a result of the water heater "A" having the same top and bottom diameters, with no interfering asymmetries or extraneous parts on one but not the other end. In other embodiments, for example a gas water heater or a clothes dryer, the top cap and base cap may differ.

The base cap 20 is octagonal, and includes four major sides 21—opposing sides 21 being parallel to each other and defining, respectively, a width "W". The corners of the major sides 21 are truncated to form minor sides 22 intermediate the major sides 21 and defining a second respective width "W" less than width "W". Opposing minor sides 22 are likewise parallel to each other. The minor sides 22 result in a savings in material, a more compact package and, in addition, provide impact areas which spread the impact force laterally along adjacent major sides 21 instead of radially inwardly towards the water heater "A".

Base cap 20 also includes a centrally-positioned annular shoulder 23 defining a top surface 24 of reduced thickness. This annular shoulder 23 fits snugly against the cylindrical side walls of the water heater "A". An annular void 25 in the center of the base cap 20 reduces the amount of material used to form the base cap 20 and provides access to the top or bottom of the water heater, if needed.

Figure 4:
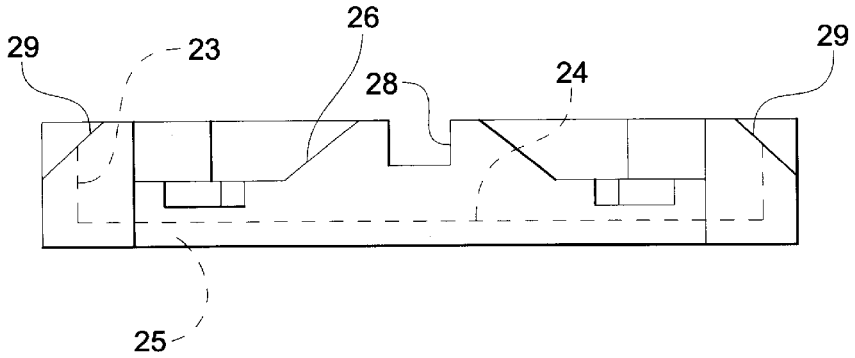
FIG. 4 is a side elevation of the top cap or base cap shown in FIG. 3, taken along lines 4—4.

Referring now to FIGS. 3 and 4, base cap 20 includes four axially-extending enlarged flanges 26 integrally molded into the four major sides 21 of the base cap 20. As is best shown in FIG. 4, each flange 26 includes a notch 28 defined by the walls of the flange 26. Four supports 29 having a curved surface lying in the same plane as the shoulder 23 fits against the walls of the water heater "A". These supports provide additional support to the water heater "A" and also to the base cap 20.

In this particular embodiment, the base cap 20 is a mirror image of itself through any diametrical line, but in other embodiments asymmetries may be present. The principal point is that the mold from which the base cap 20 is molded is made to fit the exact shape of the bottom of the appliance in order to fit tightly and provide maximum protection. In situations where the top and bottom of the appliance has a different configuration, then differently molded top and base caps would preferably be used. Since in this embodiment the base cap 20 and top cap 40 are identical and are merely inverted relative to each other in position on the water heater "A", the elements of top cap 40 are numbered identically to those of base cap 20.

Figure 5:
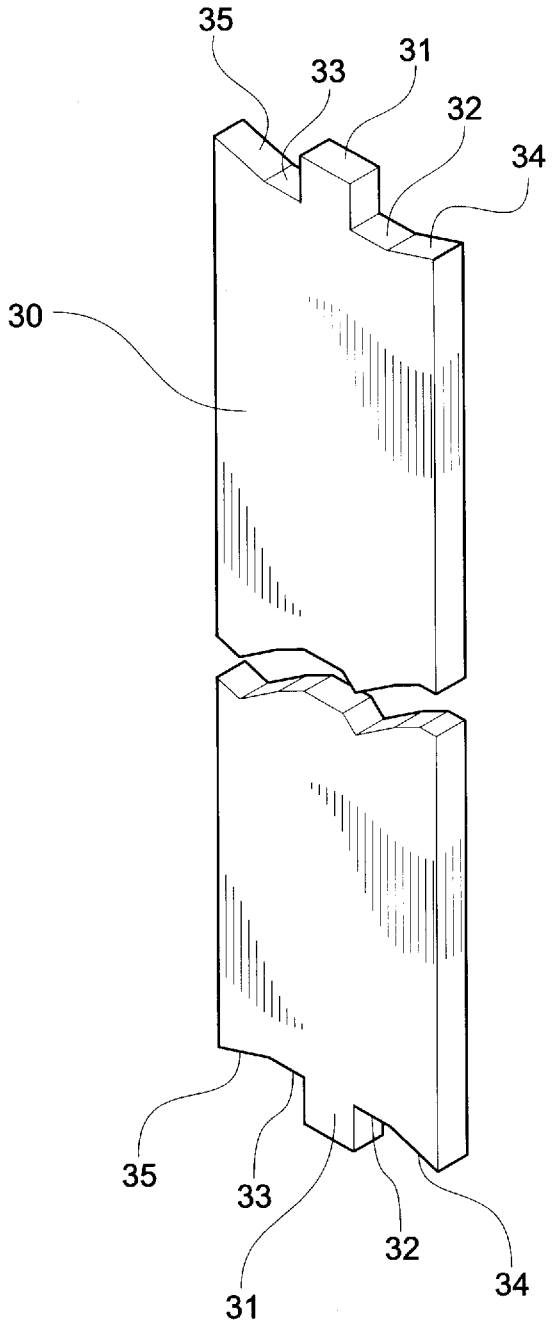
FIG. 5 is a fragmentary perspective view of a side panel according to a preferred embodiment of the invention.

Referring now to FIG. 5, a side panel 30 is shown. Side panel 30 is essentially a foam plank or board of proper length with male connecting members 31 on opposite ends. In the embodiment shown, the side panel 30 is a mirror image of itself on both lateral and longitudinal center lines. However, in other embodiments the side panel could be wider on one end than the other, have enlarged or reduced-thickness areas to accommodate recessed or protruding parts of the appliance, or could have differently-shaped connecting members.

Side panel 30 includes connecting members in the form of a tab 31 integrally-molded into the side panel's opposite ends. As is best shown in FIGS. 1 and 2, these tabs 31 are intended to be positioned in the notches 28 of the base cap 20 and the top cap 40. As is also shown, the opposing ends of the side panel 30 include recesses 32 and 33 adjacent the tab 31 and tapered shoulders 34 and 35 which match and mate with the shape of the flanges 26 in the base cap 20 and top cap 40.

Preferably, the tabs 31 of the side panel 30 are held in position in the notches 28 of the base cap 20 and top cap 40 by a light press fit, there being sufficient friction between the mated parts to keep the assembly together until the plastic shroud 50 is fitted over the assembled package 10 and is shrunk into place. If properly dimensioned, the naturally pebbly texture of the foam create a satisfactory frictional engagement. However, in other applications where the appliance may be subject to repeated movement or reorientation before assembly of the package is complete, a type of snap-fit locking tab could be molded into the side panel, or tape or a spot of hot-melt adhesive could be used to provide a more robust connection until after shrinkage of the shroud 50 takes place.

In the embodiment disclosed in this application, four side panels 30 are used—one on each of four quadrants of the cylindrical water heater "A". Space between the side panels 30 remains open, thus reducing weight and permitting positive visual inspection of the water heater "A". This provides maximum strength to the assembled package 10, and permits the assembled package to be picked up from any direction. As noted above, these packages are normally picked up and moved by squeezing two or three together to form a frictionally-engaged unit.

Therefore, it is only necessary for there to be two opposed side panels 30. Thus, in situations where a protrusion, such as on a gas water heater, makes it difficult to place a side panel on one of the four sides, three or even two side panels 30 can be used.

The base cap 20, side panel 30 and top cap 40 are injection-molded of a polymeric material such as expanded polystyrene. This material has long been used for packaging, and its processing and use characteristics are well known. The material is extremely lightweight, strong, has high energy absorbing characteristics and thus crushes at a slow rate. If necessary it can be easily cut with a mechanical cutting implement or a hot air knife and further shaped after molding. It is easily recyclable, with mold waste, trim pieces and used components capable of being ground into pellets and remolded.

Preferably, the expanded polystyrene weighs 2 lb/ft$^3$ (*.) or less, with the most preferred weight being 1.3 lb/ft$^3$ for the particular use described in this application.

After the base cap 20, top cap 40 and side panels 30 have been properly assembled as shown in FIG. 2, the tubular plastic shroud 50 is pulled down over the assembly from top to bottom. Care should be taken to tuck 6–12 inches (15–30 cm) of the plastic film under the base cap 20. When in place, the top of the tubular shroud 50 is closed by bringing material on the top end of the shroud 50 together and heat-sealing the material together to form a seam 51 across the top of the package 10. See FIG. 1. During this step, the base cap 20, top cap 40 and side panels 30 are held together only by the frictional engagement of the tabs 31 in the notches 28. The diameter of the tubular shroud 50 should be sufficiently larger than the largest diametrical dimension of the assembled component so that it can be easily placed in position, while proper shrinkage creates a tight fit. A shroud diameter about 20% larger than the largest diametrical dimension of the assembled base cap 20, top cap 40 and side panels 30 is ordinarily sufficient to permit proper placement.

Sufficient heat is applied to the shroud 50 to shrink the shroud 50 tightly into position around the assembled components. This can be done most easily by passing the entire assembly through a heat tunnel. The film from which the shroud 50 is fabricated is preferably polyethylene shrink film having a thickness of 10 mils. Of course, other thicknesses and materials may also be used. Polyethylene film having a 10 mil thickness is extremely strong, and when properly shrunk into position completely immobilizes the base cap 20, side panels 30 and top cap 40, locking them together and providing an extremely secure protective package. Punctures in the film will not ordinarily result in any degradation of protection to the appliance. The shroud 50 is sufficiently robust that even the open areas between the side panels 30 and the void 25 in the top cap 40 are protected against damage from almost any impact except a deep puncture-type impact sufficient to penetrate the film and continue on to impact the water heater "A" itself.

The package 10 can be removed from the water heater "A" very easily merely by cutting the shroud 50 with a blade along the length of the water heater "A" in an area between two of the side panels 30 and across at least a part of the top cap 40. Then, the top cap 40 is lifted of f of the top of the water heater "A" and the side panels 30 removed. The water heater "A" is then lifted off of the base cap 20.

A protective package for an appliance is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. A protective shipping and storage package for appliances, comprising:

(a) a polymeric foam protective base cap for being fitted onto a base of an appliance, said base cap defining first and second pairs of mutually opposed planar sides and third and fourth pairs of mutually opposed planar sides adjacent respective ones of said first and second pairs of sides, said first, second, third and fourth pairs of sides extending around a periphery of the base cap;

(b) a polymeric foam protective top cap for being fitted onto a top of the appliance, said top cap defining first and second pairs of mutually opposed planar sides and third and fourth pairs of mutually opposed planar sides adjacent respective ones of said first and second pairs of sides, said first, second, third and fourth pairs of sides extending around a periphery of the top cap;

(c) a plurality of planar protective side panels for being positioned in spaced apart relation around the appliance and interconnecting said base and top caps, said side panels having opposite ends for respectively engaging and cooperating with the third and fourth pairs of opposed sides of the base cap and top cap in the same plane as the third and fourth pairs of sides to form a protective package around the appliance; and (d) retaining means cooperating with said top cap, base cap and at least some of said side panels for securing the protective package in its protective position around the appliance.

2. A protective shipping and storage package according to claim 1, wherein said top cap and said base cap each include inner walls molded to snugly fit a predetermined appliance shape.

3. A protective shipping and storage package according to claim 2, wherein said top cap and base cap each include connection means for connecting to a respective one of said side panels.

4. A protective shipping and storage package according to claim 3, wherein said side panels each include connection means for mating connection with the connection means of said top cap and said base cap.

5. A protective shipping and storage package according to claim 3, wherein said top cap and base cap connection means comprise respective male and female connecting members.

6. A protective shipping and storage package according to claim 5, wherein each of said female connecting members comprises a notch.

7. A protective shipping and storage package according to claim 6, wherein each of said male connecting members comprises a tab for being positioned in a respective one of said notches.

8. A protective shipping and storage package according to claim 7, wherein said notches extend through the entire thickness of respective top and bottom caps and said tabs extend through the entire thickness of respective side panels, said side panels being fabricated of polymeric foam.

9. A protective shipping and storage package according to claim 5, wherein said male and female connecting members cooperate together for a press fit.

10. A protective shipping and storage package according to claim 1, wherein a single side of said third and fourth opposed pairs of sides has a lesser width than a single side of the first and second opposed pairs of sides.

11. A protective shipping and storage package according to claim 1, wherein said retaining means comprises a sheet material.

12. A protective shipping and storage package according to claim 11, wherein said sheet material comprises a plastic film.

13. A protective shipping and storage package according to claim 12, wherein said plastic film comprises a heat-shrinkable plastic film.

14. A protective shipping and storage package according to claim 1, wherein said retaining means comprises a heat-shrinkable plastic film, and further wherein said plastic film is formed into a tubular shroud having dimensions in an initial unshrunk condition to be placed over and around the assembled appliance, top cap, base cap and side panels, and a degree of shrinkage sufficient to tightly secure the protective top cap, base cap and side panels to the appliance when shrunk.

15. A protective shipping and storage package according to claim 14, wherein the appliance comprises a cylindrical water heater, and further wherein said protective package includes four side panels spaced at regular intervals around the periphery of the water heater.

16. A protective shipping and storage package according to claim 1, wherein the first and second pairs of sides reside at an angle of 45 degrees to the third and fourth pairs of sides.

* * * * *